US011399608B2

(12) United States Patent
Huang et al.

(10) Patent No.: US 11,399,608 B2
(45) Date of Patent: Aug. 2, 2022

(54) CARD CLAMP

(71) Applicant: DONGGUAN CASEKEY INDUSTRY CO., LTD, Dongguan (CN)

(72) Inventors: Haiyan Huang, Dongguan (CN); Youguo Zhou, Dongguan (CN)

(73) Assignee: DONGGUAN CASEKEY INDUSTRY CO., LTD, Dongguan (CN)

( * ) Notice: Subject to any disclaimer, the term of this patent is extended or adjusted under 35 U.S.C. 154(b) by 199 days.

(21) Appl. No.: 16/927,653

(22) Filed: Jul. 13, 2020

(65) Prior Publication Data

US 2020/0337426 A1 Oct. 29, 2020

Related U.S. Application Data

(63) Continuation of application No. PCT/CN2018/121017, filed on Dec. 14, 2018.

(30) Foreign Application Priority Data

Jan. 12, 2018 (CN) ..... 201820050257.1

(51) Int. Cl.
*A45C 11/18* (2006.01)
*A45C 1/06* (2006.01)

(52) U.S. Cl.
CPC ..... *A45C 11/182* (2013.01); *A45C 1/06* (2013.01); *A45C 2001/065* (2013.01); *A45C 2001/067* (2013.01)

(58) Field of Classification Search
CPC ... A45C 11/182; A45C 1/06; A45C 2001/065; A45C 13/30
USPC ..... 150/147
See application file for complete search history.

(56) References Cited

U.S. PATENT DOCUMENTS

| | | | |
|---|---|---|---|
| 10,065,776 | B2 | 9/2018 | Prevot et al. |
| 2013/0276943 | A1 | 10/2013 | Minn et al. |
| 2019/0359373 | A1 | 11/2019 | Glass et al. |

FOREIGN PATENT DOCUMENTS

| | | | |
|---|---|---|---|
| CN | 201734032 | U | 2/2011 |
| CN | 203392256 | U | 1/2014 |
| CN | 205030660 | U | 2/2016 |
| CN | 205668712 | U | 11/2016 |
| CN | 207784539 | U | 8/2018 |

OTHER PUBLICATIONS

Internation Search Report of PCT/CN2018/121017, dated Feb. 27, 2019.

*Primary Examiner* — Sue A Weaver
(74) *Attorney, Agent, or Firm* — True Shepherd LLC; Andrew C. Cheng

(57) ABSTRACT

A card clamp is provided. The card clamp includes a first clamping plate (1), a second clamping plate (2), a connecting belt (3), a first metal connector and a second metal connector. The first clamping plate (1) is provided with a first through groove (4), a first side surface (5) and a second side surface. The first side surface (5) and the second side surface are parallel to each other. The first through groove (4) penetrates through the first side surface (5) and the second side surface. The second clamping plate (2) is provided with a second through groove (7), a third side surface (8) and a fourth side surface, The third side surface (8) and the fourth side surface are parallel to each other. The second through groove (7) penetrates the third side surface (8) and the fourth side surface.

6 Claims, 2 Drawing Sheets

CARD CLAMP

CROSS-REFERENCE TO RELATED APPLICATIONS

This application is a continuation of International Patent Application No. PCT/CN2018/121017 with a filing date of Dec. 14, 2018, designating the United States, now pending, and further claims priority to Chinese Patent Application No. 201820050257.1 with a filing date of Jan. 12, 2018. The content of the aforementioned applications, including any intervening amendments thereto, are incorporated herein by reference.

TECHNICAL FIELD

The invention relates to the technical field of card clamps for placing card items, particularly to a card clamp.

BACKGROUND

With the living needs of people, many cards are used such as bank cards, driving licenses, ID cards, membership cards, admission cards and debit cards. Preservation of excessive cards is a problem. Existing wallets generally have special pockets, but have some disadvantages when used to place the cards: Due to the elasticity of leather or artificial leather material used, the cards are easily bent and deformed in the pockets, and the number of the cards that can be placed is limited.

There is an urgent need for a card clamp which is convenient for accessing the cards and has a compact and simple overall structure.

Technical Solution

One purpose of the invention is to provide a card clamp. The card clamp is simple and convenient, is convenient for finding cards quickly, can resist an external squeezing force to prevent the cards from being bent or deformed, and simultaneously can be used to place different numbers of cards according to different usage groups.

To achieve the purpose, the invention adopts the following technical solutions: a card clamp includes a first clamping plate, a second clamping plate, a connecting belt, a first metal connector and a second metal connector; the first clamping plate is provided with a first through groove, a first side surface and a second side surface; the first side surface and the second side surface are parallel to each other; the first through groove penetrates through the first side surface and the second side surface; the second clamping plate is provided with a second through groove, a third side surface and a fourth side surface; the third side surface and the fourth side surface are parallel to each other; the second through groove penetrates the third side surface and the fourth side surface; the connecting belt has elasticity; the connecting belt penetrates successively through the first through groove and the second through groove; a first end of the connecting belt is fixedly connected with a fixed end of the first metal connector; a second end of the connecting belt is fixedly connected with a fixed end of the second metal connector; a movable end of the first metal connector is connected with a movable end of the second metal connector; and the first metal connector and the second metal connector are located in the second through groove.

As a preferred technical solution, the first metal connector includes a first bending arm, a second bending arm and a first plate; one side of the first bending arm is fixedly connected with a first side of the first plate; one side of the second bending arm is fixedly connected with a second side of the first plate; the first side of the first plate and the second side of the first plate are parallel to each other; the other side of the first bending arm is connected with the other side of the second bending arm; and the first metal connector is fixedly connected with the first plate.

The second metal connector includes a third bending arm, a fourth bending arm and a second plate; one side of the third bending arm is fixedly connected with a first side of the second plate; one side of the fourth bending arm is fixedly connected with a second side of the second plate; the first side of the second plate and the second side of the second plate are parallel to each other; the other side of the third bending arm is connected with the other side of the fourth bending arm; and the second metal connector is fixedly connected with the second plate.

As a preferred technical solution, bending U-shaped hooks are arranged on the first plate and the second plate; and the bending U-shaped hook of the first plate is clamped with the bending U-shaped hook of the second plate.

As a preferred technical solution, the first bending arm and the second bending arm are provided with first square through holes; and edges of the first square through holes are provided with first sharp point bending hooks bent toward the first plate.

As a preferred technical solution, the number of the first sharp point bending hooks on each of the first square through holes is larger than one.

As a preferred technical solution, the third bending arm and the fourth bending arm are provided with second square through holes; and edges of the second square through holes are provided with second sharp point bending hooks bent toward the second plate.

As a preferred technical solution, the number of the second sharp point bending hooks on each of the second square through holes is larger than one.

As a preferred technical solution, the first clamping plate is provided with a fifth side surface; the second clamping plate is provided with a sixth side surface; the fifth side surface is connected with the first side surface and the second side surface; the sixth side surface is connected with the third side surface and the fourth side surface; and the fifth side surface and the sixth side surface are located on the same side and provided with a groove position.

Beneficial Effect

The beneficial effects of the invention are as follows: the card clamp is provided, which can realize quick and easy access of the cards, and has strong storage reliability and compact overall structure.

DESCRIPTION OF THE DRAWINGS

The invention is further described in detail below according to the drawings and embodiments.

In FIG. 1 to FIG. 3:

1. first clamping plate; 2. second clamping plate; 3. connecting belt; 4. first through groove; 5. first side surface; 6. fifth side surface; 7. second through groove; 8. third side surface; 9. sixth side surface; 10. first bending arm; 11. second bending arm; 12. first sharp point bending hook; 13. second sharp point bending hook; 14. first plate; 15. second plate; 16. first square through hole; 17. second square through hole; and 18. groove position.

DETAILED DESCRIPTION OF PREFERRED EMBODIMENTS

The technical solutions of the invention are further described below with reference to the drawings and through specific embodiments.

Figure 1:
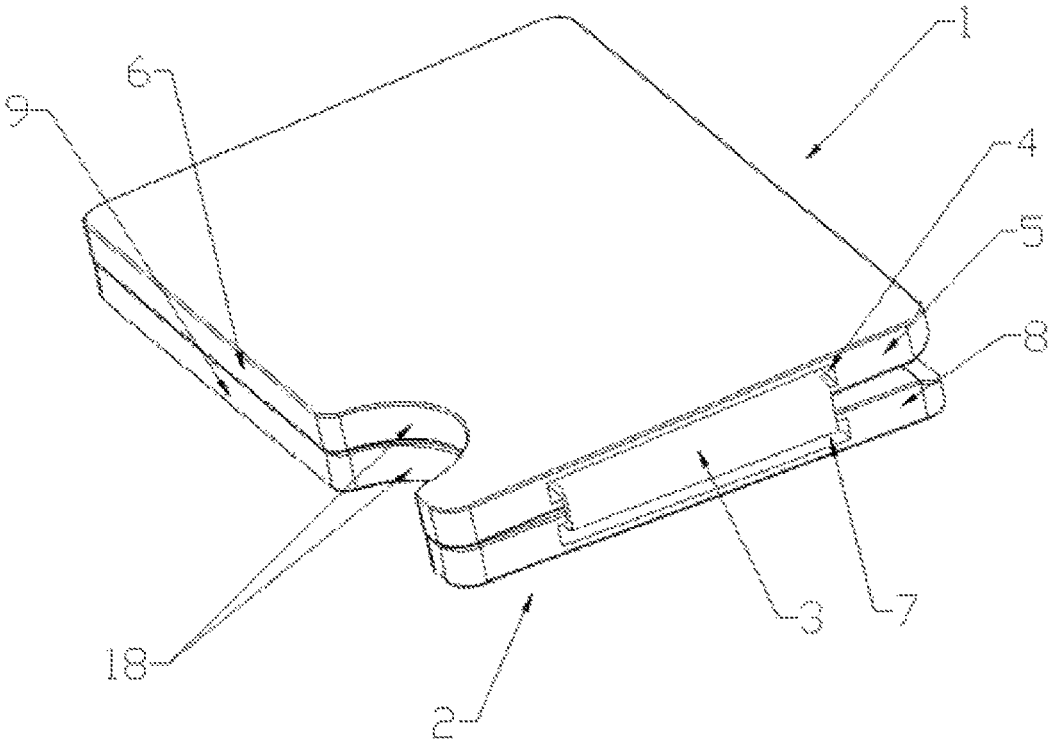
FIG. 1 is an overall schematic diagram of a card clamp according to an embodiment.
Figure 2:
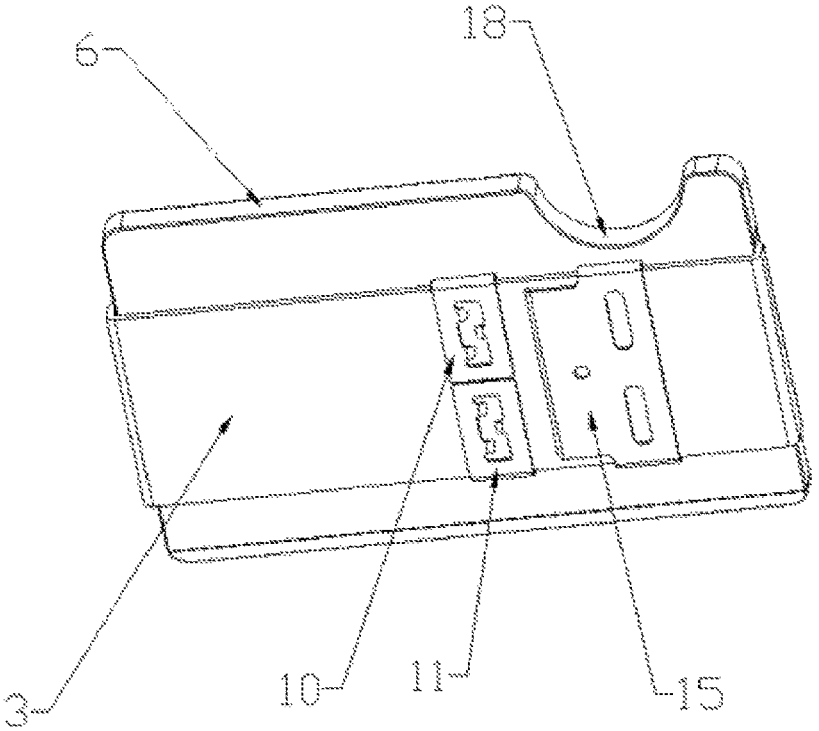
FIG. 2 is a partial schematic diagram of a card clamp according to an embodiment (a second clamping plate is not shown)
Figure 3:
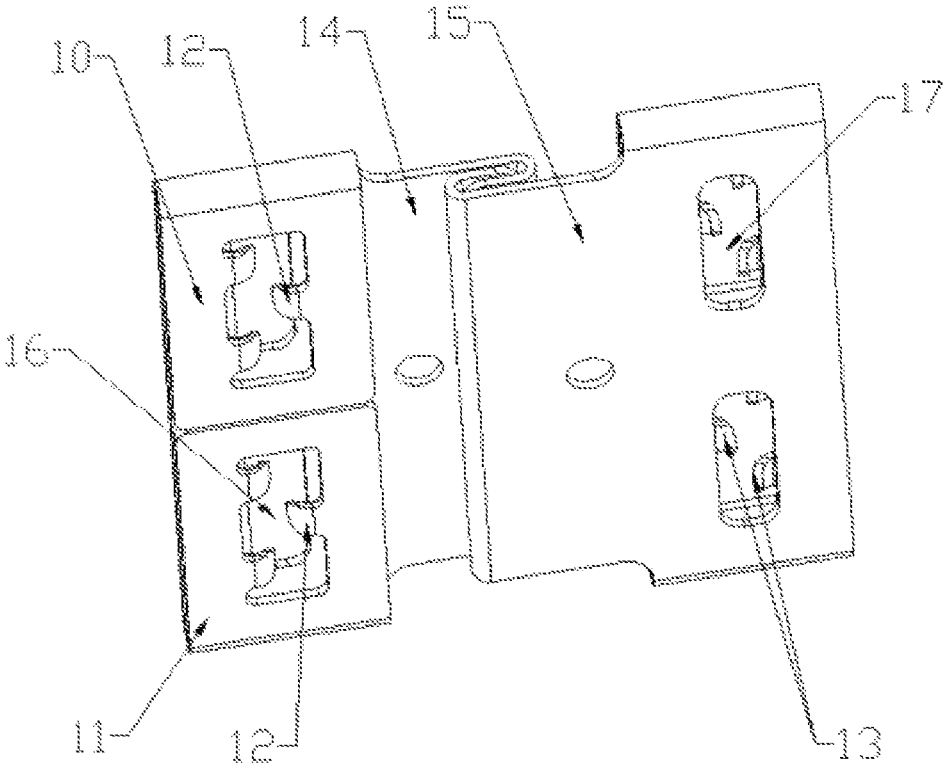
FIG. 3 is a schematic diagram of a connection relationship between a first metal connector and a second metal connector according to an embodiment.

As shown in FIG. 1 to FIG. 3, in the present embodiment, a card clamp includes a first clamping plate 1, a second clamping plate 2, a connecting belt 3, a first metal connector and a second metal connector; the first clamping plate 1 is provided with a first through groove 4, a first side surface and a second side surface; the first side surface 5 and the second side surface are parallel to each other; the first through groove 4 penetrates through the first side surface 5 and the second side surface; the second clamping plate 2 is provided with a second through groove 7, a third side surface 8 and a fourth side surface; the third side surface 8 and the fourth side surface are parallel to each other; the second through groove 7 penetrates the third side surface 8 and the fourth side surface; the connecting belt 3 has elasticity; the connecting belt 3 penetrates successively through the first through groove 4 and the second through groove 7; a first end of the connecting belt 3 is fixedly connected with a fixed end of the first metal connector; a second end of the connecting belt 3 is fixedly connected with a fixed end of the second metal connector; a movable end of the first metal connector is connected with a movable end of the second metal connector; and the first metal connector and the second metal connector are located in the second through groove 7.

Since the connecting belt 3 has elasticity, under the connection of the first metal connector and the second metal connector, the first clamping plate 1 and the second clamping plate 2 clamp a card therebetween. When the first clamping plate 1 and the second clamping plate 2 are manually pulled, it is easy to take out the card between the plates, and after releasing the hand, under the drive of the connecting belt 3, the first clamping plate 1 and the second clamping plate 2 can quickly clamp the unremoved card.

In the present embodiment, the first metal connector includes a first bending arm 10, a second bending arm 11 and a first plate 14; one side of the first bending arm 10 is fixedly connected with a first side of the first plate 14; one side of the second bending arm 11 is fixedly connected with a second side of the first plate 14; the first side of the first plate 14 and the second side of the first plate 14 are parallel to each other; the other side of the first bending arm 10 is connected with the other side of the second bending arm 11; and the first metal connector is fixedly connected with the first plate 14. The second metal connector includes a third bending arm, a fourth bending arm and a second plate 15; one side of the third bending arm is fixedly connected with a first side of the second plate 15; one side of the fourth bending arm is fixedly connected with a second side of the second plate 15; the first side of the second plate 15 and the second side of the second plate 15 are parallel to each other; the other side of the third bending arm is connected with the other side of the fourth bending arm; and the second metal connector is fixedly connected with the second plate 15.

While the first bending arm 10 and the second bending arm 11 are connected with the first plate 14, the first bending arm 10, the second bending arm 11 and the first plate 14 are bent and wrapped on the first end of the connecting belt 3. While the third bending arm and the fourth bending arm are connected with the second plate 15, the third bending arm, the fourth bending arm and the second plate 15 are bent and wrapped on the second end of the connecting belt 3; and the connecting belt 3 is connected from head to tail under the condition that the connecting belt 3 penetrates through the first through groove 4 and the second through groove 7.

In the present embodiment, bending U-shaped hooks are arranged on the first plate 14 and the second plate 15; and the bending U-shaped hook of the first plate 14 is clamped with the bending U-shaped hook of the second plate 15.

In the present embodiment, the first bending arm 10 and the second bending arm 11 are provided with first square through holes 16; and edges of the first square through holes 16 are provided with first sharp point bending hooks 12 bent toward the first plate 14. The number of the first sharp point bending hooks 12 on each of the first square through holes 16 is three. The third bending arm and the fourth bending arm are provided with second square through holes 17; and edges of the second square through holes 17 are provided with second sharp point bending hooks 13 bent toward the second plate 15. The number of the second sharp point bending hooks 13 on each of the second square through holes 17 is three.

Three first sharp point bending hooks 12 and three second sharp point bending hooks 13 are respectively arranged on the first square through holes 16 and the second square through holes 17, so that the first bending arm 10 and the second bending arm 11 are hooked on the first end of the connecting belt 3, while the third bending arm and the fourth bending arm are hooked on the second end of the connecting belt 3.

The first metal connector and the second metal connector are connected and then located in the second through groove 7 of the second clamping plate 2.

In the present embodiment, the first clamping plate 1 is provided with a fifth side surface 6; the second clamping plate 2 is provided with a sixth side surface 9; the fifth side surface 6 is connected with the first side surface 5 and the second side surface; the sixth side surface 9 is connected with the third side surface 8 and the fourth side surface; and the fifth side surface 6 and the sixth side surface 9 are located on the same side and provided with a groove position 18.

The card can be accessed through the groove position 18.

In the present embodiment, the sectional shape of the groove position 18 is semicircular. In other embodiments, the shape of the groove position 18 can also be trapezoidal or triangular.

It should be stated that the above specific embodiments are only preferred embodiments of the invention and the applied technical principles. Within the technical scope disclosed by the invention, any change or replacement which is easily contemplated by those skilled in the art shall be covered in the protection scope of the invention.

We claim:

1. A card clamp, comprising a first clamping plate, a second clamping plate, a connecting belt, a first metal connector and a second metal connector;

wherein the first clamping plate is provided with a first through groove, a first side surface and a second side surface; the first side surface and the second side surface are parallel to each other; the first through groove penetrates through the first side surface and the second side surface; the second clamping plate is provided with a second through groove, a third side surface and a fourth side surface; the third side surface and the fourth side surface are parallel to each other; the second through groove penetrates the third side surface and the fourth side surface; the connecting belt has elasticity; the connecting belt penetrates successively through the first through groove and the second through groove; a first end of the connecting belt is fixedly connected with a fixed end of the first metal connector; a second end of the connecting belt is fixedly connected with a fixed end of the second metal connector; a movable end of the first metal connector is connected with a movable end of the second metal connector; and the first metal connector and the second metal connector are located in the second through groove.

2. The card clamp of claim 1, wherein the first metal connector comprises a first bending arm, a second bending arm and a first plate; one side of the first bending arm is fixedly connected with a first side of the first plate; one side of the second bending arm is fixedly connected with a second side of the first plate; the first side of the first plate and the second side of the first plate are parallel to each other; the other side of the first bending arm is connected with the other side of the second bending arm; and the first metal connector is fixedly connected with the first plate;

the second metal connector comprises a third bending arm, a fourth bending arm and a second plate; one side of the third bending arm is fixedly connected with a first side of the second plate; one side of the fourth bending arm is fixedly connected with a second side of the second plate; the first side of the second plate and the second side of the second plate are parallel to each other; the other side of the third bending arm is connected with the other side of the fourth bending arm; and the second metal connector is fixedly connected with the second plate.

3. The card clamp of claim 2, wherein bending U-shaped hooks are arranged on the first plate and the second plate; and the bending U-shaped hook of the first plate is clamped with the bending U-shaped hook of the second plate.

4. The card clamp of claim 2, wherein the first bending arm and the second bending arm are provided with first square through holes; and edges of the first square through holes are provided with first sharp point bending hooks bent toward the first plate.

5. The card clamp of claim 2, wherein the third bending arm and the fourth bending arm are provided with second square through holes; and edges of the second square through holes are provided with second sharp point bending hooks bent toward the second plate.

6. The card clamp of claim 1, wherein the first clamping plate is provided with a fifth side surface; the second clamping plate is provided with a sixth side surface; the fifth side surface is connected with the first side surface and the second side surface; the sixth side surface is connected with the third side surface and the fourth side surface; and the fifth side surface and the sixth side surface are located on the same side and provided with a groove position.

* * * * *